US005882432A

United States Patent [19]

Jody et al.

[11] Patent Number: 5,882,432

[45] Date of Patent: Mar. 16, 1999

[54] EFFICIENT CONTINUOUS DRYER FOR FLEXIBLE POLYURETHANE FOAM AND CLEANING APPARATUS

[75] Inventors: Bassam Jody, Chicago; Edward Daniels, Oak Lawn; Joseph A. Libera, Clarendon Hills, all of Ill.

[73] Assignee: The University of Chicago, Chicago, Ill.

[21] Appl. No.: 692,801

[22] Filed: Jul. 30, 1996

[51] Int. Cl.[6] ..... B08B 3/00; B08B 1/02

[52] U.S. Cl. ..... 134/26; 134/21; 134/32; 134/30

[58] Field of Search ..... 134/26, 21, 32, 134/30

[56] References Cited

U.S. PATENT DOCUMENTS 4,098,649 7/1978 Redker .
4,728,045 3/1988 Tomaszek .
5,169,588 12/1992 Estepp .
5,198,471 3/1993 Nauman .
5,222,267 6/1993 Fierro ..... 8/158
5,250,197 10/1993 Marcel ..... 210/787

*Primary Examiner*—Ponnathapura Achutamurthy
*Assistant Examiner*—P. Ponnaluri
*Attorney, Agent, or Firm*—Emrich & Dithmar

[57] ABSTRACT

A method of cleaning polyurethane foams where the material is transported through a wash station while alternately soaking the polyurethane foam in an organic solvent and squeezing solvent from the polyurethane foam a number of times. Then the polyurethane foam is sent through a rinse or solvent transfer station for reducing the concentration of solvent in the foam. The rinsed polyurethane foam is sent to a drying station wherein the foam is repeatedly squeezed while being exposed to hot air to remove wet air from the foam.

28 Claims, 4 Drawing Sheets

EFFICIENT CONTINUOUS DRYER FOR FLEXIBLE POLYURETHANE FOAM AND CLEANING APPARATUS

CONTRACTUAL ORIGIN OF THE INVENTION

The United States Government has rights in this invention pursuant to Contract No. W-31-109-ENG-38 between the U.S. Department of Energy and The University of Chicago representing Argonne National Laboratory.

BACKGROUND OF THE INVENTION

This invention relates to a continuous process for cleaning and drying flexible porous materials such as foam and more particularly, polyurethane foam recovered from foam containing waste streams such as automobile shredder residue. Contaminants in the foam primarily are oils and other organics as well as dirt.

Specifically, the invention relates to apparatus and system for processing the foam through a series of devices which repeatedly squeeze and release the foam to allow solvent in a washing apparatus to infiltrate the pore structure of the foam and then be mechanically squeezed therefrom a plurality of times.

In addition to which the invention includes apparatus for rinsing the cleaned foam to rid the foam of the organic solvents and thereafter to dry the foam also with repeated mechanical squeezing of the foam to reduce the amount of time the foam resides in the solvent transfer station (referred to here sometimes as a rinse station) and the dryer. Complete flow processes are disclosed for recycling and treating various waste streams from the washing station, the rinsing station, and the drying station.

SUMMARY OF THE INVENTION

A principal object of the present invention is to provide a system for removing organic oils, greases and inorganic dirt from foam like materials and more particularly, from polyurethane foam from automobile shredder residue.

Another object of the invention is to provide a system including a washing station, a rinsing or solvent transfer station and a drying station in which the resident time of the foam in any station is short.

Yet another object of the present invention is to provide a system of the type set forth in which the organic solvent and water in the system are recovered and recycled for continuous use, thereby minimizing emissions to the environment.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

DETAILED DESCRIPTION OF THE PREFERRED EMBODIMENT

Figure 1:
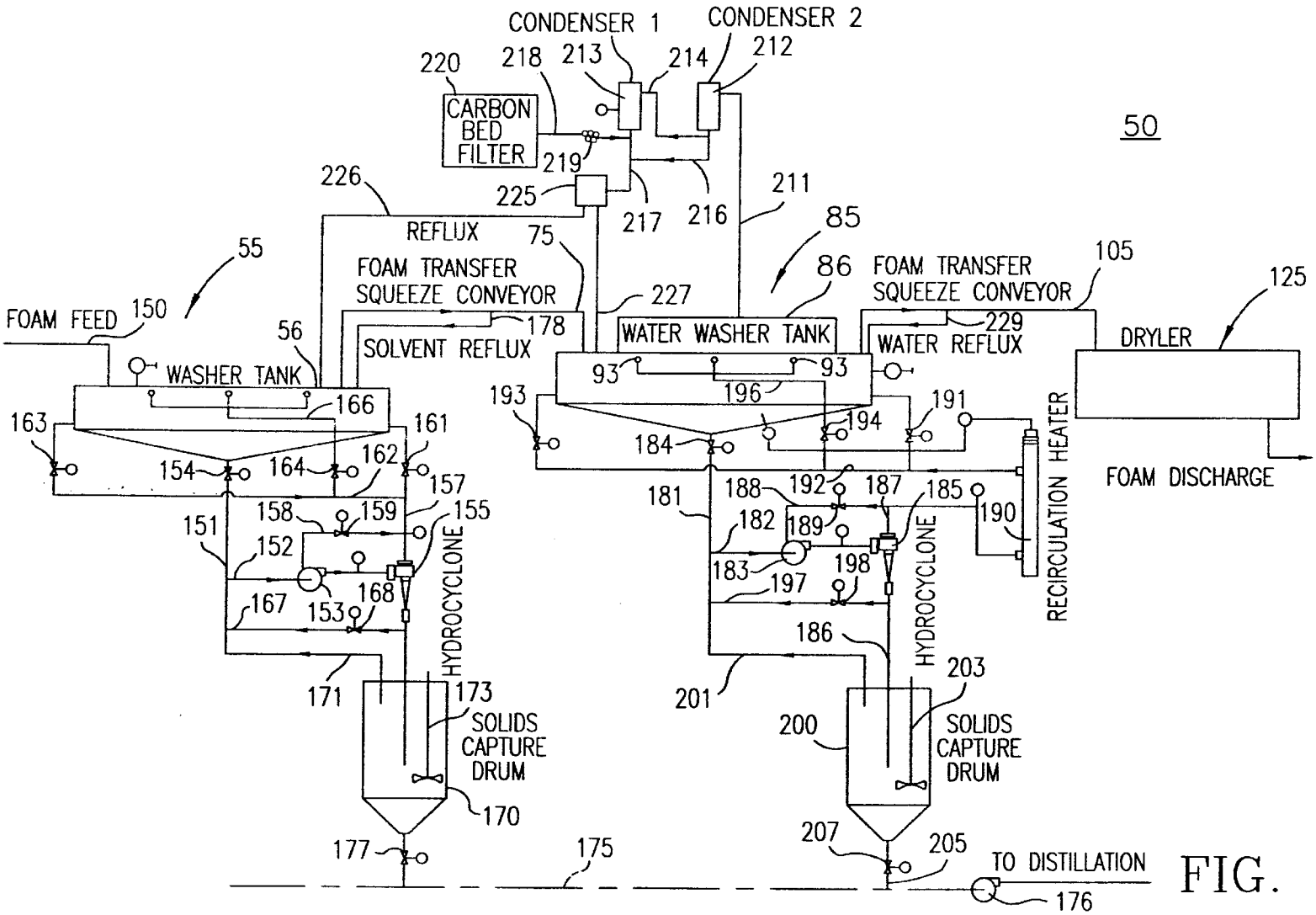
FIG. 1 is a schematic process flow diagram showing the system, apparatus and method of the present invention.
Figure 2:
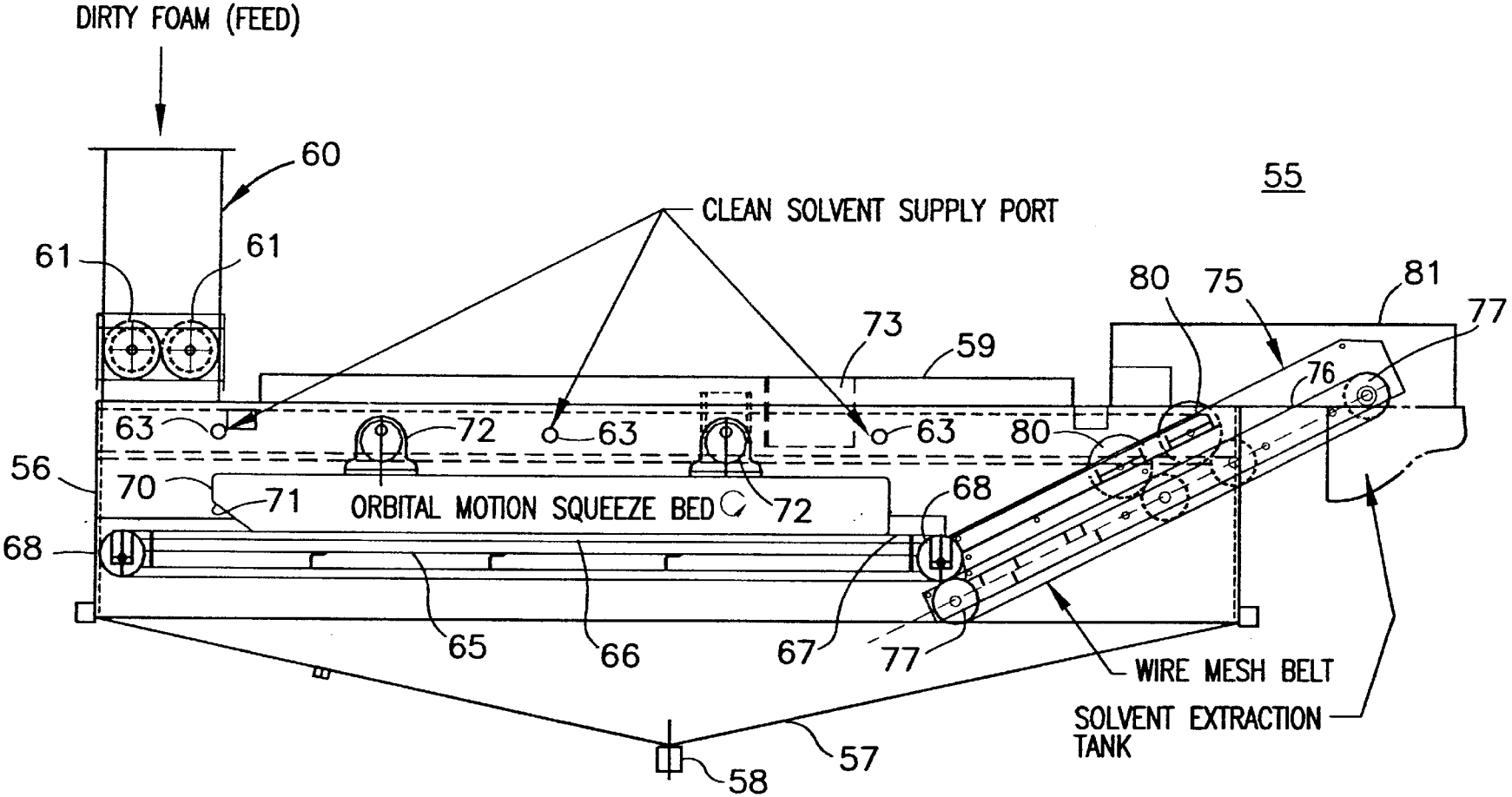
FIG. 2 is a schematic representation of the washing station of the present invention.

Referring now to the drawings, there is disclosed in FIG. 1 a foam treatment process 50 which includes a washing station 55, a solvent transfer station 85 and a drying station 125. More particularly, by reference to FIG. 2, the washing station 55 includes a tank 56 which has a sloping bottom portion 57 leading to an outlet 58. The tank 56 is enclosed by a cover 59 which is provided with an inlet chute 60 through which dirty foam is fed into the washing station 55. A pair of rollers 61 is positioned within the chute 60 to provide both feeding mechanism as well as a vapor lock mechanism for the washing station 55, thereby to prevent the escape of organic solvent vapors from the station 55. A plurality of clean solvent supply ports 63 spaced axially of the longitudinally extending washing station 55 are provided to introduce clean solvent into the washing station. The solvent can also be supplied in a counterflow made with respect to the foam to increase the dirt loading in the solvent and reduce the rate at which the solvent is regenerated.

Inside the washing station 55 is a longitudinally extending support bed 65 which includes a perforate base plate 66 which may be made of any suitable material such as Teflon or stainless steel on which is supported a mesh conveyor belt 67 extending around pulleys 68 positioned one at the inlet end of the washing station 55 and the other toward the outlet end of the washing station.

An orbital motion bed or plate 70 having a chamfered inlet surface 71 is supported on a pair of eccentric drives 72, one of which is provided with an eccentric drive motor 73. As disclosed in FIG. 2, the orbital motion bed 70 rotates in a counterclock wise direction so as to move foam from the inlet chute 60 thereof toward the outlet end of the washing station 55. This forward motion is promoted by the slippage at the wire mesh idling belt due to the forward shear force established through the foam by the bed. An outlet feed conveyor 75 is located at the outlet end of the washing station 55 and is provided with a conveyor belt 76 positioned around a pair of pulleys 77 which receives pieces of polyurethane foam from the conveyor belt 67 and transports same angularly upwardly out of the washing station 55. A pair of squeeze rollers 80 positioned intermediate the pulleys 77 physically compress the foam as it leaves the washing station 55 so as to express fluid such that the foam leaving the washing station 55 has absorbed therein fluid generally not more than about its own weight.

Finally, a cover 81 is positioned over the outlet portion of the station 55 cooperating with the cover 59 entirely to close the washing station 55 to prevent the escape of organic solvent vapors into the atmosphere.

Solvents suitable for use in the washing station 55 are perchloroethylene, tetrachloroethylene, various alcohols, acetone, hexane, and various mixtures thereof including "green solvents" (that is biodegradeable solvents) along with other organic solvents which are suitable to dissolve automobile oils and greases normally found in polyurethane foam from automobile shredder residue. Although the invention is described with reference to the preferred organic solvent perchloroethylene, it is not meant to be limiting in any way whatsoever, but merely for illustrative purposes only. In addition, the reciprocating bed is one way to squeeze the foam. Other forms including rollers and pressure can be used to accomplish the same objective. This is also true in the case of the solvent exchange bed described below.

Figure 3:
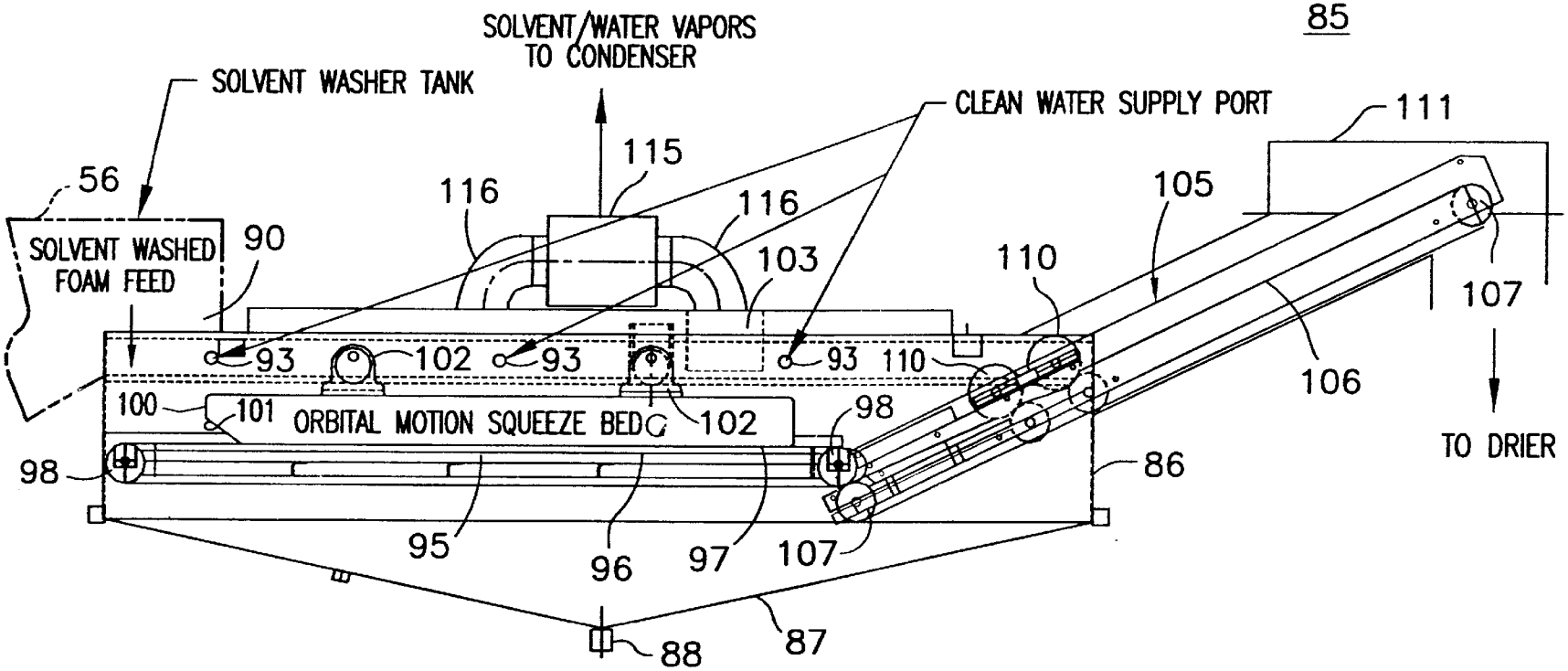
FIG. 3 is a schematic representation of the rinsing or solvent transfer station of the present invention.

Referring now to FIG. 3, there is disclosed the solvent transfer station 85 which includes a solvent extraction tank 86 provided with a sloping bottom 87 and an outlet 88. A cover 89 covers the majority of the tank 86. The tank 86 may be similar or identical in most respects to the tank 56. An inlet 90 receives foam from the washing station 55 and introduces the foam segments into the solvent transfer or rinse station. A plurality of clean water supply ports 93 feed water into the extraction tank 86 to a level which covers a support bed 95 positioned below a perforated base plate 96 also below a mesh conveyor belt 97 positioned around a pair of pulleys 98. The configuration is similar to that previously described for the washing station 55.

An orbital bed 100 is positioned slightly above the conveyor belt 97, the orbital bed having a chamfered inlet surface 101 and a pair of eccentric drives 102, one of which being connected to an eccentric drive motor 103. The orbital motion of the bed 100 is counterclock wise as is the orbital motion of the bed 70, both of which move downwardly and to the right as viewed in the drawings in order to compress polyurethane foam segments which are positioned between the bed and the adjacent conveyor belt and support bed underneath same.

An outfeed conveyor 105 is located at the end of the tank 86 away from the inlet 90 and includes a conveyor belt 106 positioned around a pair of pulleys 107. Intermediate the pulleys 107 are squeeze rollers 110 which cooperate to express water from the polyurethane foam being transported on the conveyor 106 so that the foam contains water not in excess of about its own weight as it leaves the rinsing station 85. A cover 111 is positioned over the conveyor 105 to enclose the solvent transfer or rinse station 85 in the same manner that the washing station 55 is enclosed, thereby to prevent the evaporation of any organic solvent to the atmosphere. Vapors such as steam and evaporated solvent are conducted out of the solvent transfer or rinse station 85 by means of a vapor duct 115 connected to the top of cover 89 on the tank 86 by means of a pair of conduits 116, the vapor duct 115 being connected to an exhaust fan 219 (as will be described), so that the rinsing station 85 as well as the washing station 55 are operated under negative pressure. Also not shown: vapors are condensed and separated. Solvent refluxes to the solvent tank and water refluxes to the water tank.

Figure 4:
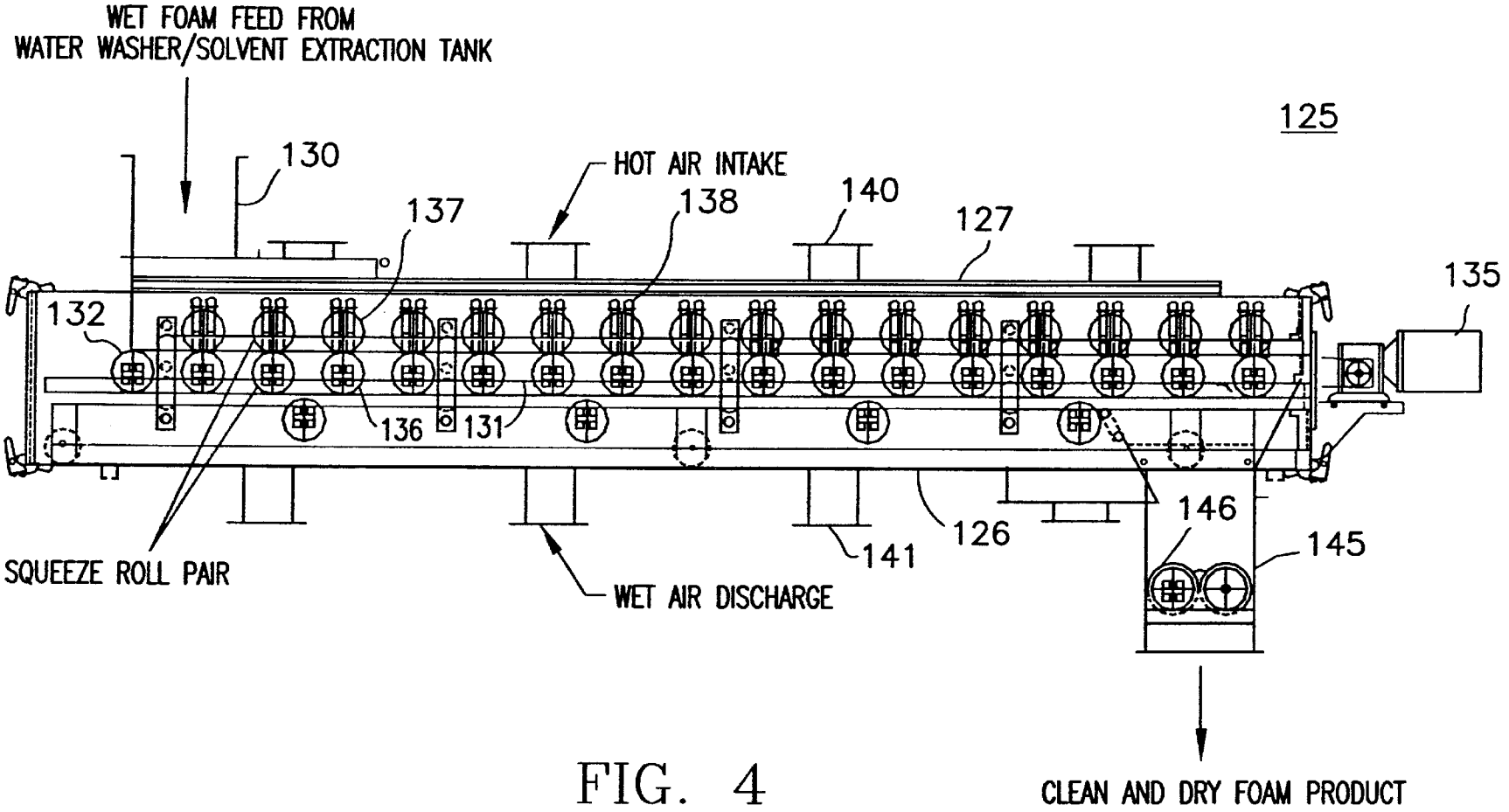
FIG. 4 is a schematic representation of the drying station of the present invention.

The drying station 125 is more particularly shown in FIG. 4 and includes an elongated chamber 126 provided with an enclosure 127. An inlet chute 130 directs foam segments from the rinsing station 85 to a conveyor belt 131 extending axially of the drying station 125, the belt being supported by a pair of pulleys 132, one of which is connected to a motor 135 for transporting the conveyor belt 131 in a clockwise direction thereby to move the polyurethane foam segments from the inlet end of the dryer 125 to the outlet end of the dryer.

A plurality of transversely extending axially spaced apart bottom rollers 136 are positioned below the upper flight of the conveyor belt 131 and cooperate with a plurality of rollers 137 in registry with selected ones of the bottom rollers 136. The top rollers 137 are spring loaded as at 138 to provide a plurality of compressions to the polyurethane foam being transported on the conveyor belt 131. Actually, the springs provide relief against incompressible contaminants such as metal tramp. Normally, fixed rollers compress foam adequately. Springs are for safety, and the gap between the upper roller and belt is typically ⅛ inch, and can be adjusted. Each compression of the polyurethane foam as it passes through the pairs of rollers 136, 137 causes hot moist air to be expressed from the foam to be replaced intermediate the rollers by hot dry air as the foam expands. While being squeezed, the hot belt roller aids in evaporation by direct heat conduction. The succession of squeezing steps facilitates the drying of the foam such that the foam can be dried in less than about 15 minutes of residence time in the drying station 125. Air is introduced into the drying station 125 through a plurality of hot air inlets 140 and hot air is removed from the drying station 125 by a plurality of wet air discharge conduits 141. The movement of air in the drying station 125 is in a cross countercurrent mode relative to the foam moving through the drying station from the left to the right as viewed in the drawing. The combination of cross current and countercurrent flow enhances the drying efficiency in the drying station 125.

An outlet chute 145 is located at the right hand end of the drying station 125 and includes a pair of vapor lock rollers 146 preventing cold air contamination.

Operation of the system will now be explained by reference particularly to FIG. 1 of the drawings.

Referring now to FIG. 1, there is seen that segments of polyurethane foam are fed via a conveyor or other suitable mechanism 150 into the wash station 55. The wash station 55 has suitable organic solvent therein such as perc maintained at a liquid level in the tank 56 so as to cover the bed 70 at its highest point. The orbital bed 70 is operated such that segments of foam passing between the bed and the support bed 65 are squeezed between about 20 and about 100 times during the transportation through the wash station 55. There is a direct relationship between the geometry of the eccentric drive and the forward progress stroke. The present design achieves about 1 inch of forward motion stroke. The frequency does not affect the number of squeezes, but does change the residence time. The periodic squeezing of the foam serves to enhance the dissolution of any grease and oil in the foam as well as dislodging inorganic dirt and grit from the foam, all of which collects at the bottom of the tank 56. The squeezing results also in the discharging of the dirt loaded solvent out of the foam to be replaced with cleaner solvent and thus enhances the cleaning efficiency. The dirty solvent, dirt and grit, exits the tank 56 through an outlet line 151 which branches as at line 152 to a pump 153, the pump 153 serves to transport dirty solvent and solids into a hydrocyclone 155. A valve 154 is in the line 151 serves to control when solvent is removed from the tank 56 through the outlet 58 thereof.

The hydrocyclone 155 operates in the same manner as any other hydrocyclone and is provided with a solid outlet 156 and an overhead line 157. The overhead line 157 branches into a line 158 controlled by a valve 159 which recycles to the inlet end of the pump 153 to provide recycle ability of the overhead from the hydrocyclone 155. Valves 161 and 163 are used to wash down the bottom of the tank 56 to rid the tank of accumulated dirt and sludge.

Accordingly, it is seen that cleaned perc or other solvent, if used, from the hydrocyclone 155, can be recycled to the tank 56 at a variety of locations to provide cleaner solvent to the foam segments as they enter the tank 56, as they proceed through the tank 56 and as they are exiting the tank 56. The hydrocyclone 155 extracts dirt, but not soluble components. The latter is controlled by continuous distillation.

A line 156 from the bottom of the hydrocyclone 155 is branched as at 167 and controlled by valve 168 to recycle the bottoms from the hydrocyclone back through the pump 153, and hence, into the hydrocyclone again for further separation. If the valve 168 is closed, then the bottoms from the hydrocyclone 155 are transported to a solid catch or drum 170 which is provided with an overhead line 171 which leads to the pump 153 via the line 152. The solid catch or drum 170 is also provided with a stirrer 173 or agitator so that the material in the drums is agitated during the removal of same through the outlet line 175 controlled by a valve 177. A pump 176 pulls and transports the bottoms from the drum 170 to a distillation facility, not shown.

Finally, a perc reflux line 178 is provided from the cover 181 of the washing station 55 back to the tank 56 so that perc squeezed from the foam during the transfer thereof from the washing station 55 to the rinsing or solvent transfer station 85 by passage through the squeeze rolls 80 can be recycled into the tank 56 and not be wasted.

Still referring to FIG. 1 of the drawings, the rinse or solvent transfer station 85 is provided with a dirty water outlet line 181 connected to the discharge port 88 which leads through a line 182 to a pump 183 for transportation the dirty water from the rinsing or solvent transfer station to a hydrocyclone 185. A valve 184 is positioned in the line 181 intermediate the discharge port 88 and the pump 183 to control the discharge cycles from the rinse station 85. As may be imagined, some of the water in the rinsing station 85 is contaminated with organic solvent and grit or dirt dragged over from the washing station 55 by the residual liquid in the foam segments transported into the wash station through the inlet chute 90. Technically, the water steam strips the solvent and an additional function of the water is to dissolve water soluble dirt remaining in the foam.

The hydrocyclone 185 is similar in construction to the hydrocyclone 155 and is provided with a bottoms outlet 186 and an overhead line 187. The overhead line 187 leads to a recycle line 188 controlled by a valve 189, the recycle line 188 feeding to the inlet end of the pump 183. Valves 191 and 193 are used in wash down purposes as previously described.

Valves 193 and 194 control the recirculation of hot water from the heater 190 to the rinse tank 86, the hot water in the tank 186 generally being maintained in the range of from about 85° C. to about 100° C. for optimum results. Water temperatures in excess of 100° C. causes too much water to evaporate while temperatures less than about 85° C. require the foam to be in the rinse station 85 longer than the desired 15 minutes. In general, the foam is present in the rinse station in the range of from about 3 to about 15 minutes which is the same as the residence time of the polyurethane foam in the wash station.

The hydrocyclone 185 with the bottoms or solids outlet 186 is also provided with a recycle line 197 with a control valve 198 to recycle a portion of the outlet from the hydrocyclone 185, the bottoms 186 leading to a solids capture drum 200 similar to the drum 170. An overhead line 201 leads to the recycle circuit previously described while a stirrer or agitator 203 is provided in the drum 200 so that when the valve 207 is opened and the outlet line 205 is activated, liquids as well as solids leave the drum 200 and are transported through the line 175 and the pump 176 to a distillation facility, not shown.

The rinsing station 85 and more particularly the tank 86 is provided with an overhead outlet 211 connected to the vapor duct 115, the line 211 leading to a pair of condensers 212 and 213 interconnected by a line 214. An outlet line 216 from the condenser 212 joins an outlet line 217 from the condenser 213 and leads to a decanter 225 which separates any perc from the water and recycles the perc through line 226 to the washing station 55 and the water through line 227 to the rinse station 85. Another line 218 from condenser 213 controlled by exhaust fan 219 transmitting vapor such as non-condensible air with residual perc and water to a carbon bed filter 220 for final cleaning.

Finally, a water reflux line 229 is provided in the outlet conveyor 105 from the rinse station 85 to the dryer 125 thereby to conserve water and to recycle same as it is squeezed from the foam as the foam leaves the rinse station 85.

The foam leaving the rinse station 85 is transported to the dryer through the inlet 130 thereof where it encounters hot air preferably maintained in the range of from about 100° C. to about 150° C. 150° C. is lower than the decomposition temperature of the preferred solvent perc and also lower than the degradation temperature of the polyurethane foam commonly found in automobile shredder residue. If the system is used for different foams or with different solvents the drying temperature may be higher or lower, but in any case it is important that the maximum temperature for the hot air be less than the lower of the decomposition temperature of the solvent and the degradation temperature of the foam. In general, the residence time of the foam in the drying station 125 is the same as in the wash station 55 and the rinse station 85 and that is between about 3 and about 15 minutes.

The orbital beds 70 and 100, respectively in the washing station 55 and the rinsing station 85, are operated to provide about 20 and about 100 squeezes of the foam as it passes along the respective conveyor. The conveyors are preferably not driven. The index in response to shear force transmitted through the foam as the bed moves to the right in the bottom portion of the stroke. It has been found that this number of squeezes significantly enhances the washing efficiency in the wash station 55 and the rinsing efficiency in the rinse station 85.

Because all three pieces of equipment are completely covered, and the system is operated at negative pressure, little if any organic solvent evaporates into the atmosphere. The vapor from the condensers 212 and 213 is transmitted via a line 218 and a pump 219 to a carbon filter bed 220 thereby to prevent the discharge of any organic vapor to the atmosphere.

As can be seen, therefore, the system 50 described is a completely closed so that the fluids and the vapors from the system are always used to the maximum amount with the only material being discharged from the solid capture drums 170 and 200.

While there has been disclosed what is considered to be the preferred embodiment of the present invention, it is understood that various changes in the details may be made without departing from the spirit, or sacrificing any of the advantages of the present invention. These changes include but are not limited to the use of different solvents, various ways of squeezing the foam, and different methods of moving the foam through the beds.

The embodiments of the invention in which an exclusive property or privilege is claimed are defined as follows:

1. A method of cleaning polyurethane foam, comprising transporting polyurethane foam from a source thereof through a wash station while alternately soaking the polyurethane foam in a liquid bath of an organic solvent and squeezing solvent from the polyurethane foam a plurality of times, transporting the polyurethane foam through a rinse station, transporting the rinsed polyurethane foam to a drying station wherein the foam is repeatedly squeezed while being exposed to hot air, and continuously removing wet air from the drying station.

2. The method of claim 1, wherein the organic solvent is perchloroethylene.

3. The method of claim 1, wherein the polyurethane foam is squeezed between about 20 and about 100 times during transportation through the wash station.

4. The method of claim 1, wherein the polyurethane foam is maintained in the wash station from about 3 minutes to about 15 minutes.

5. The method of claim 1, wherein the foam is rinsed with water in the rinse station.

6. The method of claim 5, wherein the water in the rinse station is maintained at a temperature in the range of from about 85° C. to about 100° C. to produce a vapor mixture of solvent and water, and further comprising the step of transporting the vapor mixture out of the rinse station under vacuum.

7. The method of claim 6, wherein the wash station and the drying station are operated at negative pressure.

8. The method of claim 1, wherein the polyurethane foam is maintained in the rinse station between about 3 minutes and about 15 minutes.

9. The method of claim 1, wherein the temperature of hot air in the drying station does not exceed about 150° C.

10. The method of claim 9, wherein the organic solvent has a decomposition temperature and the polyurethane foam has a degradation temperature and the temperature of the hot air in the drying station is maintained at a temperature that is less than the lower of the decomposition temperature of the solvent or the degradation temperature of the polyurethane foam.

11. The method of claim 10, wherein the polyurethane foam is maintained in the drying station between about 3 minutes to about 15 minutes.

12. A method of cleaning polyurethane foam, comprising transporting polyurethane foam through a longitudinally extending wash station while alternately soaking the polyurethane foam while immersed in an organic solvent and squeezing solvent from the polyurethane foam a plurality of times by comprising the polyurethane foam as it passes axially through the wash station, conveying the polyurethane foam from the wash station to a rinse station, transporting the polyurethane foam through a water rinse station, conveying the polyurethane foam from the water rinse station to a drying station, transporting the rinsed polyurethane foam through a longitudinally extending drying station wherein the polyurethane foam is repeatedly squeezed while being exposed to hot air, and continuously removing wet air from the drying station.

13. The method of claim 1, wherein the wash station has a longitudinally extending platen spaced from a path along which the polyurethane foam travels through the wash station, and repeatedly moving the platen toward and away from the polyurethane foam during transportation thereof through the wash station to compress the polyurethane foam a plurality of times during passage of the polyurethane foam through the wash station.

14. The method of claim 13, wherein the polyurethane foam is transported through the wash station on a conveyor belt positioned below the platen.

15. The method of claim 14, wherein an outfeed conveyor is located adjacent the conveyor belt for receiving polyurethane foam from the conveyor belt after the foam has been compressed a plurality of times by movement of the platen and conveying the polyurethane foam out the organic solvent in the wash station.

16. The method of claim 15, wherein roller assemblies associated with the outfeed conveyor mechanically squeeze solvent from the polyurethane foam until the retained solvent in the polyurethane foam does not exceed about the weight of the polyurethane foam.

17. The method of claim 15, wherein the water in the rinse station is maintained at a temperature in the range of from about 85° C. to about 100° C., the wash station and the rinse station being maintained at negative pressure.

18. The method of claim 17, wherein solvent and water evaporated during operation of the rinse station are separated with water being recycled to the rinse station and solvent being recycled to the wash station.

19. The method of claim 17, wherein polyurethane foam is transported through a plurality of axially spaced apart rollers in the drying station alternately to squeeze and expand the foam.

20. The method of claim 19, wherein the organic solvent has a decomposition temperature and the polyurethane foam has a degradation temperature and hot air flow in the drying station is both counter current and cross current to the direction of foam travel.

21. The method of claim 20, wherein the hot air temperature in the drying station is maintained at a temperature that does not exceed the lesser of the decomposition temperature of the solvent or the degradation temperature of the foam.

22. A method of cleaning polyurethane foam having a degradation temperature, comprising transporting polyurethane foam through a wash station having a bath of organic solvent having a decomposition temperature while alternately soaking the polyurethane foam in a bath of the organic solvent and mechanically squeezing solvent from the polyurethane foam a plurality of times to produce polyurethane foam cleaner than at entry and solvent contaminated with dissolved organic oils and inorganic dirt dispersed in the solvent, removing contaminated organic solvent and transporting same to a cyclone separator to remove inorganic dirt and to an evaporator to separate clean organic solvent, recycling clean organic solvent to the wash station, transporting the polyurethane foam from the wash station through a hot water rinse station, collecting water vapor and organic solvent vapor from the hot water rinse station and separating the constituents to recycle the organic solvent to the wash station and the water to the rinse station, transporting the rinsed polyurethane foam from the rinse station to a drying station wherein the foam is repeatedly squeezed by passing through rollers to squeeze the foam while being exposed to counter current and cross current hot air at a temperature less than the lower of the decomposition temperature of the organic solvent and the degradation temperature of the polyurethane foam, and continuously removing wet air from the drying station.

23. The method of claim 22, wherein the organic solvent is perchloroethylene.

24. The method of claim 23, wherein the residence time of the polyurethane foam in the wash station is not more than about 15 minutes.

25. The method of claim 23, wherein the residence time of the polyurethane foam in the rinse station is not more than about 15 minutes.

26. The method of claim 23, wherein the residence time of the polyurethane foam in the drying station is not more than about 15 minutes.

27. The method of claim 22, wherein the polyurethane foam is squeezed between about 20 to about 100 times in each of the wash station and the rinse station and the drying station.

28. A method of cleaning polyurethane foam, comprising transporting polyurethane foam from a source thereof through a wash station while alternately soaking the polyurethane foam in a liquid bath of an organic solvent and squeezing solvent from the polyurethane foam a plurality of times, transporting the polyurethane foam through a rinse station, transporting the rinsed polyurethane foam to a drying station wherein the foam is repeatedly squeezed while being exposed to hot air, and continuously removing wet air from the drying station, wherein said wash station is maintained at negative pressure to prevent escape of solvent vapors to the atmosphere.

* * * * *

UNITED STATES PATENT AND TRADEMARK OFFICE

CERTIFICATE OF CORRECTION

PATENT NO. : 5,882,432
DATED : March 16, 1999
INVENTOR(S) : Bassam Jody et al.

It is certified that error appears in the above-identified patent and that said Letters Patent is hereby corrected as shown below:

Claim 12, line 5, delete "comprising" and insert --compressing--.

Line 56, References Cited insert --Recycling of Plastics In Automobile Shredder Residue, B.J.Jody, et al., Argonne National Laboratory, Argonne, IL.

Signed and Sealed this
Fourth Day of January, 2000

*Attest:*

*Attesting Officer*

*Acting Commissioner of Patents and Trademarks*